US005800160A

United States Patent [19]

Knöpfel et al.

[11] Patent Number: 5,800,160

[45] Date of Patent: Sep. 1, 1998

[54] PREMIX BURNER FOR A HEAT GENERATOR

[75] Inventors: Hans Peter Knöpfel, Besenbüren; Thomas Ruck, Mellingen, both of Switzerland

[73] Assignee: ABB Research Ltd., Zurich, Switzerland

[21] Appl. No.: 749,888

[22] Filed: Nov. 18, 1996

[30] Foreign Application Priority Data

Dec. 21, 1995 [DE] Germany ..... 195 47 914.9

[51] Int. Cl.[6] ..... F23D 14/46

[52] U.S. Cl. ..... 431/351; 431/186; 431/354

[58] Field of Search ..... 350/174, 186, 350/189, 350–354, 8–10, 187, 188, 285

[56] References Cited

U.S. PATENT DOCUMENTS

| | | | |
|---|---|---|---|
| 3,179,152 | 4/1965 | Musat et al. | 431/186 |
| 3,339,614 | 9/1967 | Fleck et al. | 431/186 |
| 3,349,826 | 10/1967 | Poole et al. | 431/186 |
| 4,781,030 | 11/1988 | Hellat et al. . | |
| 5,193,995 | 3/1993 | Keller et al. | 431/351 |
| 5,292,244 | 3/1994 | Xiong | 431/354 |

FOREIGN PATENT DOCUMENTS

| | | |
|---|---|---|
| 0321809B1 | 6/1989 | European Pat. Off. . |
| 0436113A1 | 7/1991 | European Pat. Off. . |
| 3427896A1 | 1/1986 | Germany . |
| 4412315A1 | 10/1995 | Germany . |

*Primary Examiner*—James C. Yeung

*Attorney, Agent, or Firm*—Burns, Doane, Swecker & Mathis, L.L.P.

[57] ABSTRACT

In a premix burner (100) for a heat generator, which essentially comprises at least two hollow, conical sectional bodies (101, 102) nested one inside the other in the direction of flow, the longitudinal symmetry axes (**101*b*, 102*b*) of the sectional bodies are offset from one another in such a way that the adjacent walls of these sectional bodies form air-inlet slots (119, 120), tangential in their longitudinal extent, for the throughflow of combustion air (115). On the head side, the premix burner (100) has a fuel nozzle (103) which is shifted upstream by a distance (126) relative to the cone start (125**) induced by the sectional bodies. Thus the fuel injection is caught by the combustion air only when the fuel spray cone can be penetrated more effectively, which leads to better mixture formation.

12 Claims, 5 Drawing Sheets

PREMIX BURNER FOR A HEAT GENERATOR

BACKGROUND OF THE INVENTION

1. Field of the Invention

The present invention relates to a premix burner for a combustion chamber or other heat generating apparatus.

2. Discussion of Background

If a liquid fuel is injected at the burner axis in swirl-stabilized burners, as apparent, for example, in a premix burner disclosed in U.S. Pat. No. 4,932,861 to Keller et al, the liquid column forming downstream of the fuel nozzle acts like a solid body the combustion-air flow flowing tangentially into the interior space of the premix burner. In particular, this solid body effects acts in the first region downstream of the injection. Compared with the flow without liquid-fuel injection, the combustion-air inflow in the burner head is hindered, as a result of which the tangential component of the forming swirl flow increases. This leads to a change in the flame position, which wanders further upstream into the burner interior. Injection of additional fuel along the tangential air-inlet slots raises a great risk, a flame front wondering into this region of the burner interior inevitably leads to a flaskback into the system. Furthermore, enrichment of the flame center occurs, which puts the operation of such a premix burner at a disadvantage in a variety of ways. In such an operation, several disadvantages can be found, which, although not fully enumerated, may be listed as follows:

a) The risk of flashback increases, which risk is not to be underestimated; this can easily lead to parts of the premix burner being burnt off. If this increased risk occurs, a hazard potential arises in as much as parts breaking off can cause serious damage to the machine.

b) An operation at optimum flame position with a liquid fuel must not be designed to be wide-ranging for safety reasons, whereby the premix burner has a small operating range.

c) The lack of integral thorough mixing of the fuel spray cone and the combustion-air flow inevitably leads to an increase in the NOx emissions for the abovementioned reasons.

d) In addition, the inhomogeneous mixture distribution leads to further disadvantages which cause increased pollutant emissions as well as the development of pulsations.

e) Large deviations from the optimum flow conditions for reliable and efficient combustion are to be found.

SUMMARY OF THE INVENTION

Accordingly, one object of the invention as defined in the claims, in a premix burner of the type mentioned at the beginning, is to achieve flame stabilization at maximized efficiency and with minimization of the pollutant emissions.

The essential measure of the invention relates to the position of the head-side fuel nozzle, which is shifted back upstream by a certain distance relative to the inflow of the combustion air, this distance depending on the spray angle selected. The orifice of the fuel nozzle ends up in the region of a fixed casing due to this shifting, whereby openings may at the same time be provided radially around the nozzle orifice, through which openings flushing air flows into the cross section drawn in by the fuel flowing from the fuel nozzle. The cross section of flow of these openings is selected in such a way that the air mass flow through these openings is not sufficient in gas operation to displace the backflow zone further downstream. In liquid-fuel operation, the fuel spray acts virtually as a jet pump, whereby the air mass flow through the openings increases. This produces a larger axial impulse, which displaces the backflow zone further downstream.

A further advantage of the invention consists in the fact that, due to the fuel nozzle being shifted back, the fuel spray enters with a larger cone radius into the main flow, that is into the combustion air flowing through the tangential air-inlet slots. The fuel spray has already disintegrated in this plane from a film into droplets and the cone circumference of this fuel spray has increased by a factor of 3 upon entering the region of the combustion air from the tangential air-inlet slots. The spreading of the fuel spray is thereby improved and the inflow of the combustion air is not hindered.

Finally, it should be pointed out that the air mass flow drawn in through the openings in the region of the fuel nozzle prevents wetting of the cone inner apex, since it lies as a film between fuel spray and wall and in particular defines the opening angle of the fuel spray. This opening angle remains constant over a wide load range.

A further essential advantage of the invention may be seen in the fact that the backflow zone and thus the flame position during operation can be directly influenced by varying the opening cross sections for the air mass flow in the region of the fuel nozzle.

Advantageous and convenient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
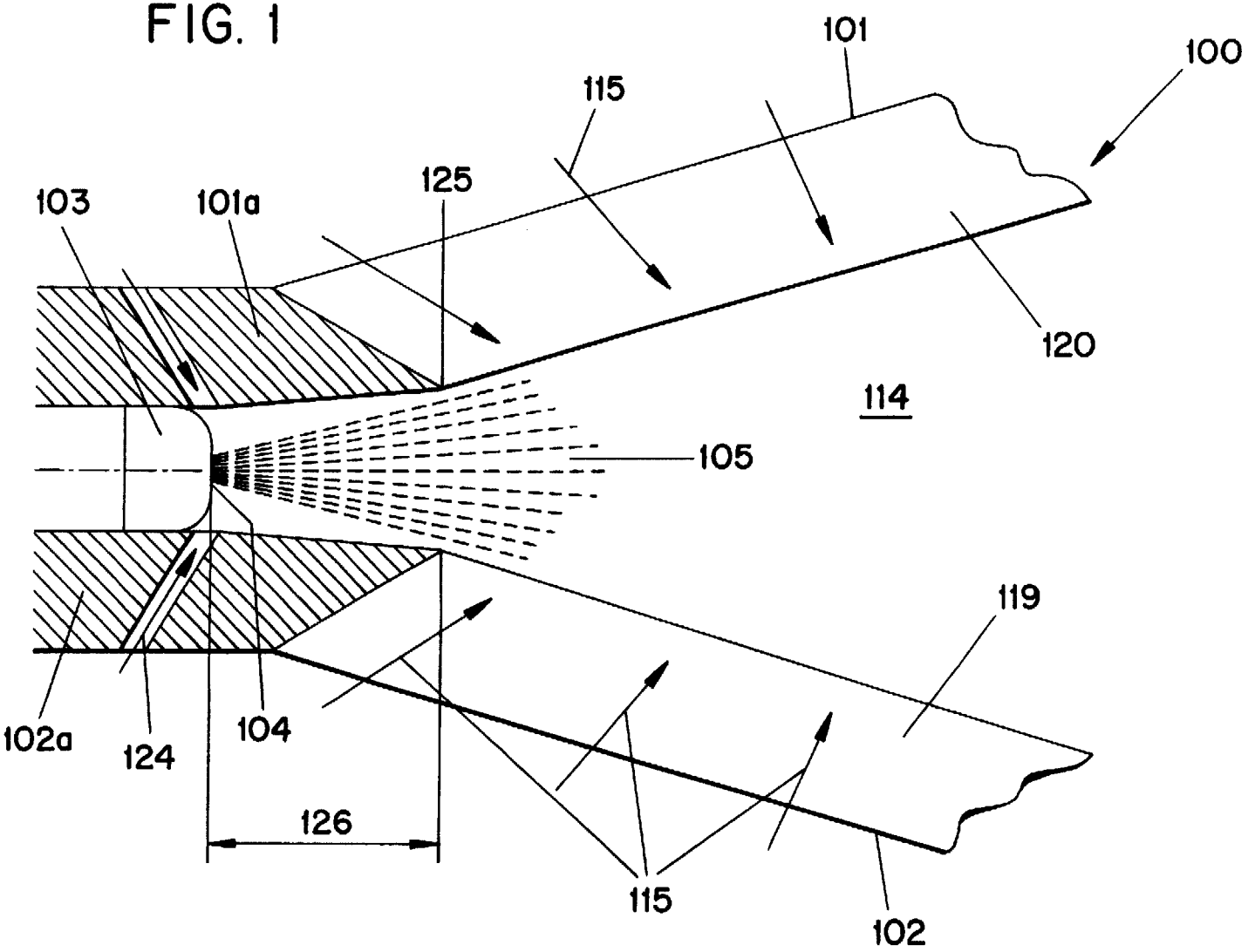
FIG. 1 shows a schematic representation of a premix burner with positioning of the fuel spray.

Reference is made now to the drawings, wherein like reference numerals designate identical or corresponding parts throughout the several views. All elements not required for understanding the invention have been omitted, and the direction of flow of the media is indicated by arrows. FIG. 1 shows a schematic representation of a premix burner which is described in more detail in the following FIGS. 2–5. The essential aspect of FIG. 1 is the representation of the concentrically placed fuel nozzle 103, which is positioned upstream relative to the inlet plane 125 of the conical interior space, the distance 126 depending on the spray angle 105 selected. The orifice 104 of the fuel nozzle 103 in thus disposed in the region of the fixed casing 101*a*, 102*a* on the head side due to this position. The fuel spray 105 arising due to the fuel nozzle 103, being shifted back enters with a larger cone radius into the region covered by the main flow of the combustion air into the interior space 114 of the burner, so that the fuel spray 105 in this region no longer behaves as a solid compact body but has already disintegrated into droplets and therefore can easily be penetrated by the combustion-air flow. The inflow of the combustion air 115 into the fuel spray 105 is therefore no longer hindered by the compactness of the fuel injection, a factor which has a positive effect on the mixing quality owing to the fact that the fuel spray 105 can be penetrated more easily by the combustion air. In addition, radially or quasi-radially arranged openings 124 are provided in the region of the plane of the fuel-spray orifice 104, through which openings 124 flushing air flows into the cross section induced by the size of the fuel nozzle 103. The cross section of flow of these openings 124 is selected in such a way that the air mass flow through these openings is not sufficient in gas operation to displace the backflow zone (cf. FIG. 2, item 106) further downstream. In liquid-fuel operation, the fuel spray 105 acts virtually as a jet pump, whereby the air mass flow through the said openings 124 increases. This produces a larger axial impulse, which displaces the backflow zone further downstream, which acts as a good measure against a flashback of the flame. The schematically shown conical sectional bodies 101, 102 are dealt with in more detail in FIGS. 2–5. The configuration and mode of operation of the tangential air-inlet slots 119, 120 are also dealt with in more detail there.

Figure 2:
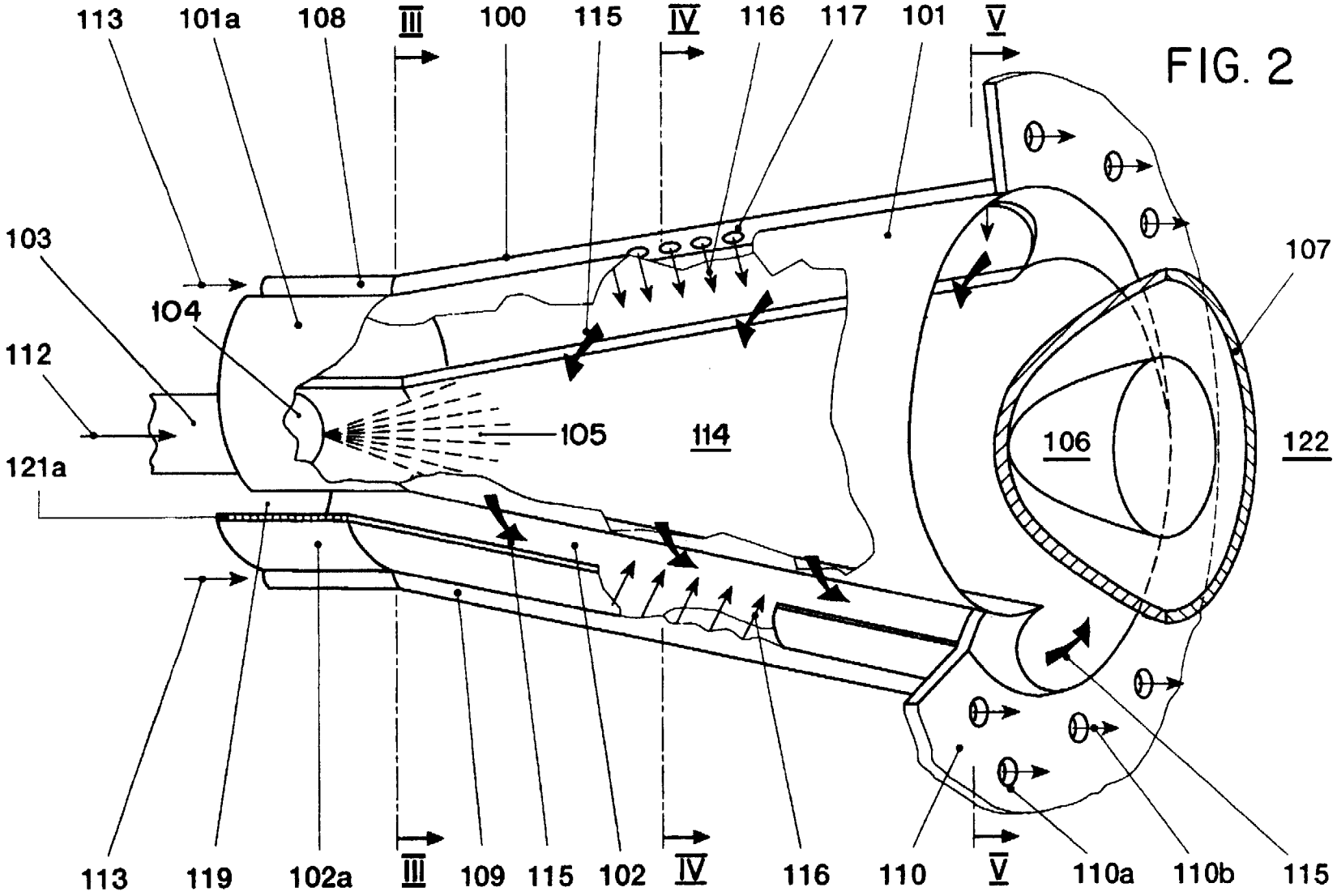
FIG. 2 shows a premix burner in perspective representation and appropriate cut-away section.
Figure 3:
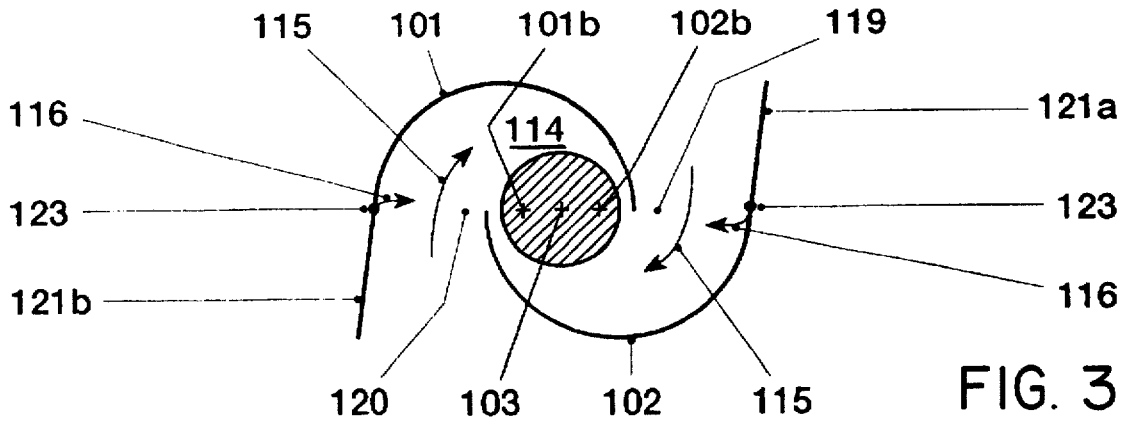
FIGS. 3–5 show views of the various section planes of the premix burner according to FIG. 2.
Figure 4:
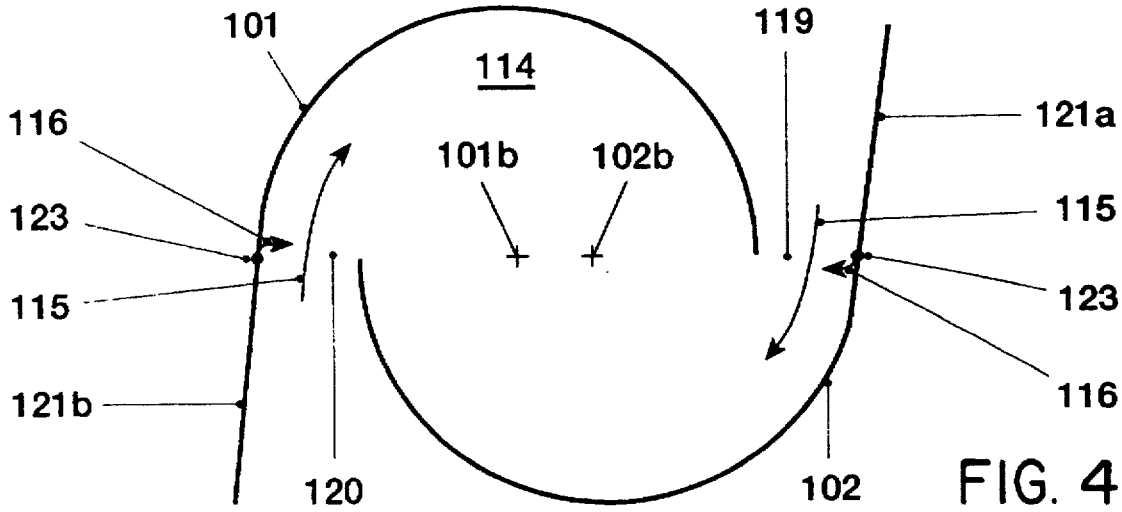
Figure 5:
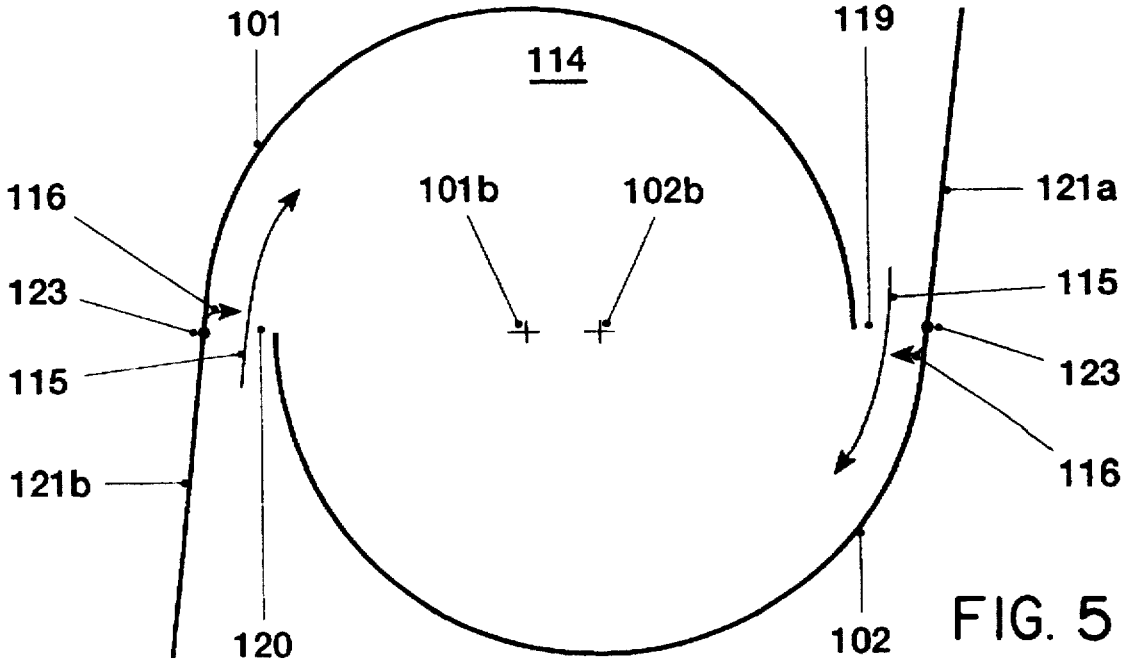

In order to better understand the construction of the burner 100, it is advantageous if the individual sections according to FIGS. 3–5 are used at the same time as FIG. 2. Furthermore, so that FIG. 2 is not made unnecessarily complex, the baffle plates 121*a*, 121*b* shown schematically according to FIGS. 3–5 are only alluded to in FIG. 2. In the description of FIG. 2, the remaining FIGS. 3–5 are referred to below when required.

Figure 6:
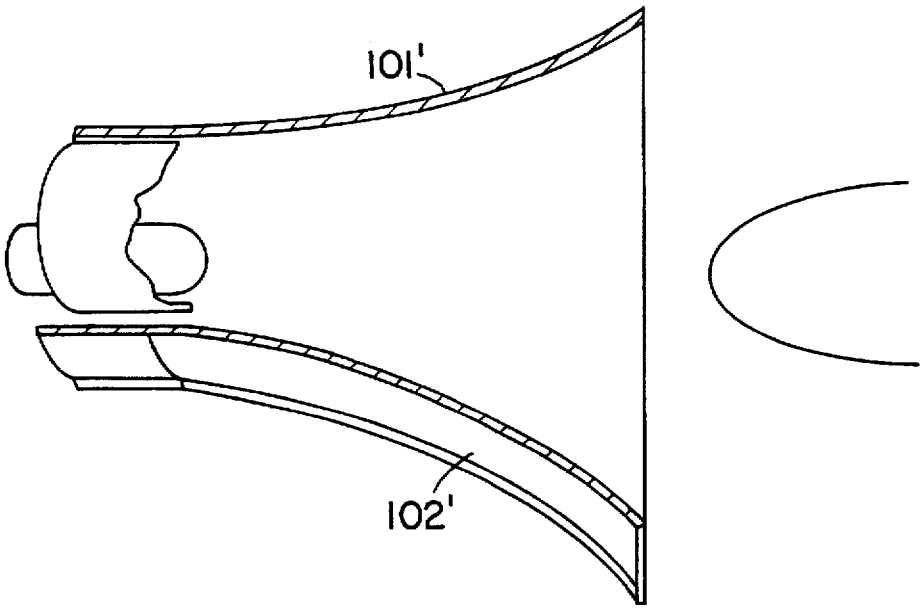
FIG. 6 shows a burner with the sectional bodies formed with a continually increasing cone angle in the flow direction.
Figure 7:
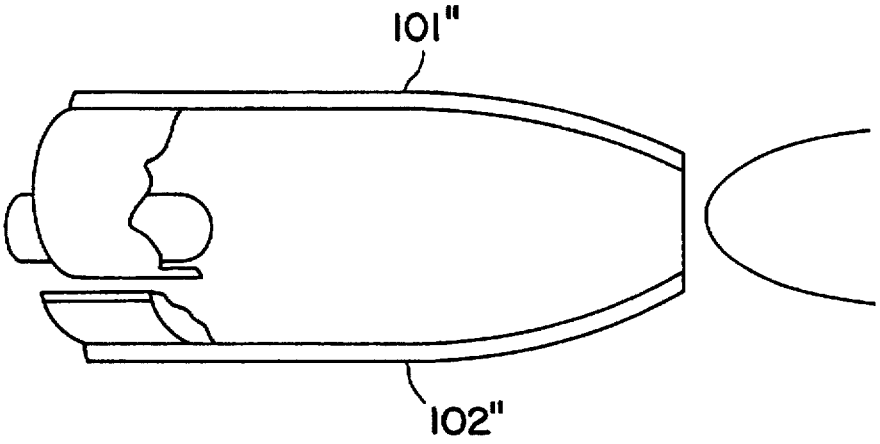
FIG. 7 shows a burner with the sectional bodies formed with a continually decreasing cone angle in the flow direction.
Figure 8:
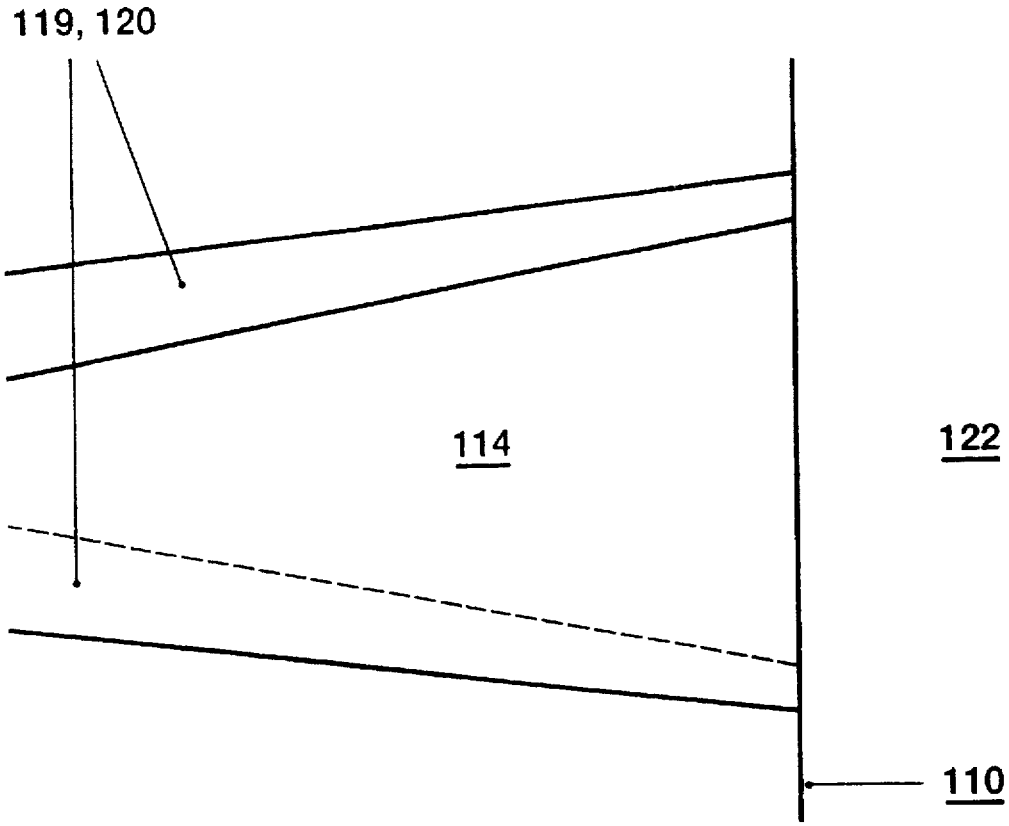
FIG. 8 is a schematic drawing of the sectional bodies shaped for air inlet slots with inlet area decreasing in the flow direction.

The burner 100 according to FIG. 2 is a premix burner and consists of two hollow conical sectional bodies 101, 102 which are nested one inside the other in a mutually offset manner to define a conical interior space. The mutual offset of the respective center axis or longitudinal symmetry axes 101*b*, 102*b* of the conical sectional bodies 101, 102 provides on each side of the interior space, in mirror-image arrangement, one tangential air-inlet slot or duct 119, 120 (cf. in particular FIGS. 3–5), through which the combustion air 115 flows into the interior space of the burner 100, i.e. into the conical hollow space 114. The conical shape of the sectional bodies 101, 102 shown has a certain fixed angle in the direction of flow. Of course, depending on operational use, the sectional bodies 101, 102 may have increasing or decreasing conicity in the direction of flow, similar to a trumpet or tulip or respectively a diffuser or confuser as shown in FIG. 6 with bodies 101' and 102' and in FIG. 7 by bodies 101" and 102", respectively. In addition, as shown in FIG. 8, the sectional bodies may be shaped so that the air inlet slots 119, 120 decrease in cross sectional area in the flow direction. The two conical sectional bodies 101, 102 each have a cylindrical initial part 101*a*, 102*a*, which parts likewise run offset from one another in a manner analogous to the conical sectional bodies 101, 102, with the result that the tangential air-inlet slots 119, 120 are present over the entire length of the burner 100. Accommodated in the region of the cylindrical initial part is a nozzle 103, which is shifted back relative to the cone inner apex, as already explained in more detail with reference to FIG. 1. The injection capacity of this nozzle 103 and its type depend on the predetermined parameters of the respective burner 100. The burner may of course be designed to be purely conical, that is without cylindrical initial parts 101*a*, 102*a*, from a single sectional body having a single tangential air-inlet slot or from more than two sectional bodies. Furthermore, the conical sectional bodies 101, 102 each have a fuel line 108, 109, which lines are arranged along the tangential air-inlet slots 119, 120 and are provided with injection openings 117, through which preferably a gaseous fuel 113 is injected into the combustion air 115 flowing through there, as the arrows 116 are intended to symbolize. These fuel lines 108, 109 are preferably positioned at the latest at the end of the tangential inflow, before entering the conical hollow space 114, in order to obtain optimum air/fuel mixing. On the combustion-space side 122, the outlet opening of the burner 100 merges into a front wall 110 in which there are a number of bores 110*a*. The last-mentioned bores 110*a* come into operation when required and ensure that diluent air or cooling air 110*b* is supplied to the front part of the combustion space 122. Furthermore, this air supply provides for flame stabilization at the outlet of the burner 100. This flame stabilization becomes important when it is a matter of supporting the compactness of the flame as a result of radial flattening. The fuel fed through the nozzle 103 is preferably a liquid fuel 112, although a gaseous fuel is not ruled out. If need be, these fuels may be enriched with a recycled exhaust gas. The liquid fuel 112 from the nozzle 103 forms a pronounced conical fuel spray 105 which is enclosed by the rotating combustion air 115 flowing in tangentially. The concentration of the fuel 112 is rapidly and continuously reduced in the axial direction by the inflowing combustion air 115, and by the shifted position of the nozzle 103 already acknowledged, to form optimum mixing. If the burner 100 is operated with a gaseous fuel 113, this preferably takes place via nozzles 117, the forming of this fuel/air mixture being achieved directly at the transition of the air-inlet slots 119, 120 to the conical hollow space 114. The injection of the fuel 112 via the nozzle 103 fulfills the function of a head stage; it normally comes into action during start-up and during part-load operation. Base-load operation with a liquid fuel is, of course, also possible via this head stage. The optimum, homogeneous fuel concentration over the cross section, on the one hand, and the critical swirl coefficient, on the other hand, appear at the end of the burner 100; the critical swirl coefficient, in interaction with the cross sectional widening disposed there, then leads to a vortex breakdown and at the same time to the formation of a backflow zone 106 there. The ignition is effected at the tip of this backflow zone 106. Only at this point can a stable flame front 107 develop. A flashback of the flame into the interior of the burner 100, as is potentially the case in known premix sections, against which a remedy is attempted with complicated flame retention baffles, need not be feared here. If the combustion air 115 is additionally preheated or enriched with a recycled exhaust gas, this provides lasting assistance for the evaporation of the liquid fuel 112, possibly used, before the combustion zone is reached. The same considerations also apply if liquid fuels are supplied via the lines 108, 109 instead of gaseous fuels. Narrow limits are to be adhered to in the configuration of the conical sectional bodies 101, 102 with regard to cone angle and width of the tangential air-inlet slots 119, 120 in order that the desired flow field of the combustion air 115 can arise with the backflow zone 106 at the outlet of the burner. In general, it may be said that a reduction in the tangential air-inlet slots 119, 120 displaces the backflow zone 106 further upstream, although this would then result in the mixture being ignited earlier. Nonetheless, it may be stated that the backflow zone 106, once it is fixed, is positionally stable per se, since the swirl coefficient increases in the direction of flow in the region of the conical shape of the burner 100. The axial velocity inside the burner 100 can be changed by a corresponding feed (not shown) of an axial combustion-air flow. Furthermore, the construction of the burner 100 is eminently suitable for changing the size of the tangential air-inlet slots 119, 120, whereby a relatively large operational range can be covered without changing the overall length of the burner 100. It is also possible to nest the conical sectional bodies 101, 102 spiral-like one inside the other.

The geometric configuration of the baffle plates 121*a*, 121*b* is illustrated in FIGS. 3–5. The baffle plates have a flow-initiating function, extending, in accordance with their length, the respective end of the conical sectional bodies 101, 102 in the oncoming-flow direction relative to the combustion air 115. The ducting of the combustion air 115 into the conical hollow space 114 can be optimized by opening or closing the baffle plates 121*a*, 121*b* about a pivot 123 placed into the conical hollow space 114 in the region of the entry of this duct, and this is especially necessary if the original gap size of the tangential air-inlet slots 119, 120 is changed. These dynamic measures may, of course, also be provided statically by makeshift baffle plates forming a fixed integral part with the conical sectional bodies 101, 102. The burner 100 may likewise be operated without baffle plates, or other aids may be provided for this.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner for a heat generator, comprising;

at least two hollow, conical sectional bodies nested one inside the other in the direction of flow to define a conical interior space having an inlet plane at a narrower end, respective longitudinal symmetry axes of the sectional bodies being mutually offset so that adjacent walls of the sectional bodies are spaced to form air-inlet slots, extending longitudinally on opposing sides of the conical interior space, for a tangentially directed inflow of combustion air into the conical interior space, and a fuel nozzle having an injection outlet to inject an axially directed fuel spray into the conical interior space, the fuel nozzle being disposed in a duct upstream of the inlet plane of the conical interior space by a predetermined distance.

2. The premix burner as claimed in claim 1, further comprising additional fuel nozzles mounted in a region of the air-inlet slots along the longitudinal extent.

3. The premix burner as claimed in claim 1, wherein the at least one fuel nozzle is connected with a liquid fuel source and the additional fuel nozzles are connected with a gaseous fuel source.

4. The premix burner as claimed in claim 1, wherein the sectional bodies define a uniformly increasing cross section of flow in the direction of flow.

5. The premix burner as claimed in claim 1, wherein the sectional bodies have a continually increasing cone angle in the direction of flow.

6. The premix burner as claimed in claim 1, wherein the sectional bodies have a continually decreasing cone angle in the direction of flow.

7. The premix burner as claimed in claim 1, wherein the sectional bodies are nested spiral-like one inside the other.

8. The premix burner as claimed in claim 1, wherein the at least one fuel nozzle positioned on the burner axis.

9. The premix burner as claimed in claim 1, wherein a cross section of flow of the tangential air-inlet slots decreases in the longitudinal direction of the burner.

10. The premix burner as claimed in claim 1, wherein openings are provided in the duct adjacent the injection outlet of the fuel nozzle, through which openings an air mass flow is directed to flow into the fuel spray from the fuel nozzle.

11. The premix burner as claimed in claim 10, wherein the openings are directed radially into the duct.

12. The premix burner as claimed in claim 10, wherein the openings are directed obliquely to an axis of the duct.

* * * * *